US010223907B2

(12) United States Patent
Brodersen et al.

(10) Patent No.: US 10,223,907 B2
(45) Date of Patent: Mar. 5, 2019

(54) SYSTEM AND METHOD FOR CAPTURING REMOTE CONTROL DEVICE COMMAND SIGNALS

(75) Inventors: Rainer Brodersen, San Jose, CA (US); Stephanie Cinereski, Mountain View, CA (US); Jack I-Chieh Fu, San Mateo, CA (US)

(73) Assignee: Apple Inc., Cupertino, CA (US)

( * ) Notice: Subject to any disclaimer, the term of this patent is extended or adjusted under 35 U.S.C. 154(b) by 3162 days.

(21) Appl. No.: 12/401,350

(22) Filed: Mar. 10, 2009

(65) Prior Publication Data

US 2010/0123598 A1 May 20, 2010

Related U.S. Application Data

(60) Provisional application No. 61/114,991, filed on Nov. 14, 2008.

(51) Int. Cl.
*G08C 19/28* (2006.01)

(52) U.S. Cl.
CPC ..... *G08C 19/28* (2013.01); *G08C 2201/20* (2013.01)

(58) Field of Classification Search
USPC ..... 340/4.41, 5.61, 12.28, 12.18, 13.23, 340/12.22, 12.11, 12.17, 12.24, 12.53, 340/12.16, 12.25, 447, 445
See application file for complete search history.

(56) References Cited

U.S. PATENT DOCUMENTS 4,626,848 A 12/1986 Ehlers
4,856,081 A * 8/1989 Smith ..... 455/151.4
4,866,434 A * 9/1989 Keenan ..... 340/12.17
5,081,534 A 1/1992 Geiger et al.
5,386,251 A 1/1995 Movshovich
5,680,115 A * 10/1997 Sim ..... 340/12.11
6,130,625 A * 10/2000 Harvey ..... 340/12.24
6,469,621 B1 * 10/2002 Vredevoogd et al. ..... 340/445
7,042,366 B1 * 5/2006 Mui et al. ..... 340/4.41
(Continued)

FOREIGN PATENT DOCUMENTS

CN 1364022 8/2002
CN 1918609 2/2007
(Continued)

OTHER PUBLICATIONS

International Search Report and Written Opinion dated Mar. 10, 2010 from Officer Carina Bergstrom in PCT Application No. PCT/US2009/064396 filed Nov. 13, 2009 entitled System and Method for Capturing Remote Control Device Command Signals, 14 pages.
(Continued)

*Primary Examiner* — Travis R Hunnings
(74) *Attorney, Agent, or Firm* — Meyertons, Hood, Kivlin, Kowert & Goetzel, P.C.

(57) ABSTRACT

Methods, systems, and apparatus for identifying protocols. In one aspect, a method includes comparing characteristics of a wireless signal received from a remote control to characteristics associated with a set of protocols. The method also includes assigning a score, based upon the comparison, to each protocol included in the plurality of protocols. The method also includes identifying a protocol from the set of protocols based upon the assigned scores. The identified protocol is substantially similar to a protocol associated with the wireless signal.

33 Claims, 17 Drawing Sheets

(56) References Cited

U.S. PATENT DOCUMENTS

| | | | | |
|---|---|---|---|---|
| 7,099,582 | B2 * | 8/2006 | Belhadj-Yahya et al. | 398/27 |
| 7,224,903 | B2 | 5/2007 | Colmenarez et al. | |
| 7,227,492 | B1 * | 6/2007 | Provis et al. | 341/176 |
| 7,274,730 | B2 * | 9/2007 | Nakabayashi | 375/220 |
| 7,375,673 | B2 * | 5/2008 | Spilo | 341/176 |
| 7,453,868 | B2 * | 11/2008 | Apfel et al. | 370/356 |
| 7,529,255 | B2 * | 5/2009 | Zlateff et al. | 370/401 |
| 7,620,988 | B1 * | 11/2009 | Hernacki | 726/23 |
| 7,656,464 | B2 | 2/2010 | Pfiffer | |
| 7,671,758 | B1 | 3/2010 | Seidel et al. | |
| 7,715,468 | B2 * | 5/2010 | Nakabayashi | 375/220 |
| 7,751,331 | B1 * | 7/2010 | Blair et al. | 370/236 |
| 7,831,627 | B2 * | 11/2010 | Chickering et al. | 707/798 |
| 8,031,270 | B1 | 10/2011 | Wisniewski et al. | |
| 8,055,802 | B2 * | 11/2011 | Choi et al. | 709/249 |
| 2002/0024943 | A1 * | 2/2002 | Karaul et al. | 370/338 |
| 2006/0112190 | A1 * | 5/2006 | Hulten et al. | 709/238 |
| 2006/0152401 | A1 * | 7/2006 | Spilo | 341/176 |
| 2007/0168429 | A1 | 7/2007 | Apfel et al. | |
| 2009/0116431 | A1 * | 5/2009 | Cadieux | 370/329 |
| 2010/0265825 | A1 * | 10/2010 | Blair et al. | 370/236 |

FOREIGN PATENT DOCUMENTS

| | | | | |
|---|---|---|---|---|
| CN | 1968348 | | 5/2007 | |
| CN | 101005668 | | 7/2007 | |
| CN | 200979743 | | 11/2007 | |
| CN | 101132494 | | 2/2008 | |
| CN | 101351788 | | 1/2009 | |
| GB | 2 366 059 | | 2/2002 | |
| JP | 61-023499 | | 1/1986 | |
| JP | H0556485 | A | 3/1993 | |
| JP | 05-153673 | | 6/1993 | |
| JP | 05164846 | | 6/1993 | |
| JP | 06-245278 | | 2/1994 | |
| JP | 10-294909 | | 11/1998 | |
| JP | 11-085777 | | 3/1999 | |
| WO | WO 98/33332 | | 7/1998 | |
| WO | WO 9833332 | A1 * | 7/1998 | H04Q 1/00 |
| WO | 98/49637 | | 11/1998 | |
| WO | WO 2006/076154 | | 7/2006 | |
| WO | WO 2010057002 | A1 * | 5/2010 | G08C 19/28 |

OTHER PUBLICATIONS

Non-Final Office Action in Korean Application No. 10-2011-7013655, dated Jul. 31, 2012, pp. 1-8.

Non-Final Office Action in Korean Application No. 10-2011-7013658, dated Jul. 31, 2012, pp. 1-8.

Office Action in Japanese Application No. 2011-536519, dated Dec. 20, 2012, 1 page.

Office Action from Chinese Application No. ZL200980154620.8, dated Apr. 30, 2014, English and Chinese versions, pp. 1-7.

Office Action from Japanese Patent Application No. 2011-536519, dated Jul. 31, 2013, (English Translation and Japanese Versions), pp. 1-4.

* cited by examiner

1000

| Protocol | Pulse Count | Phase encoding (shift) |
|---|---|---|
| NEC | 34 | no |
| NEC Repeat | 2 | no |
| Sharp | 16 | no |
| Sony SIRC | 13, 16, 20, 21 | no |
| Japan | 50 | no |
| Samsung | 34, 39 | no |
| DirecTV | 10 | no |
| DirecTV Repeat | 10 | no |
| Philips RC-5 | 7-14 | yes |
| Philips RC-6 | 11-22 | yes |
| JVC | 18 | no |
| JVC Repeat | 17 | no |
| Hitachi | 44 | no |
| Hitachi Repeat | 2 | no |
| Mitsubishi | 17 | no |

FIG. 10

1100

| Protocol | Header Pulse Width (μs) | Header Space Width (μs) |
|---|---|---|
| NEC | 9000 (6300-11700) | 4500 (3150-5850) |
| NEC Repeat | 9000 (6300-11700) | 4500 (3150-5850) |
| Sharp | - | - |
| Sony SIRC | 2400 (1680-3120) | 600 (420-780) |
| Japan | 3380 (2366-4394) | 1690 (1183-2197) |
| Samsung | 4500 (3150-5850) | 4500 (3150-5850) |
| DirecTV | 6000 (4200-7800) | 1280 (896-1664) |
| DirecTV Repeat | 3000 (2100-3900) | 1200 (840-1560) |
| Philips RC-5 | - | - |
| Philips RC-6 | 2660 (1862-3458) | 889 (622-1156) |
| JVC | 9000 (6300-11700) | 4500 (3150-5850) |
| JVC Repeat | - | - |
| Hitachi | 9000 (6300-11700) | 4500 (3150-5850) |
| Hitachi Repeat | 9000 (6300-11700) | 4500 (3150-5850) |
| Mitsubishi | - | - |

FIG. 11

1200

| Protocol | Data 0 Pulse Width (μs) | Data 0 Space Width (μs) | Data 1 Pulse Width (μs) | Data 1 Space Width (μs) |
|---|---|---|---|---|
| NEC | 560 (392-728) | 560 (392-728) | 560 (392-728) | 1690 (1183-2197) |
| Sharp | 320 (224-416) | 680 (476-884) | 320 (224-416) | 1680 (1176-2184) |
| Sony SIRC | 600 (420-780) | 600 (420-780) | 1200 (840-1560) | 600 (420-780) |
| Japan | 420 (294-546) | 420 (294-546) | 420 (294-546) | 1690 (1183-2197) |
| Samsung | 560 (392-728) | 460 (322-598) | 560 (392-728) | 1690 (1183-2197) |
| JVC | 560 (392-728) | 560 (392-728) | 560 (392-728) | 1690 (1183-2197) |
| Hitachi | 560 (392-728) | 560 (392-728) | 560 (392-728) | 1690 (1183-2197) |
| Mitsubishi | 300 (210-390) | 870 (609-1131) | 300 (210-390) | 2100 (1470-2730) |

1202

| Protocol | Data 0 Pulse Width (μs) | Data 0 Space Width (μs) | Data 1 Pulse Width (μs) | Data 1 Space Width (μs) |
|---|---|---|---|---|
| Philips RC-5 | 889 (622-1156) | 889 (622-1156) | 889 (622-1156) | 889 (622-1156) |
| Philips RC-6 | 444 (310-578) | 444 (310-578) | 444 (310-578) | 444 (310-578) |

FIG. 12

| Protocol | Data 0 Pulse or Space Width ($\mu s$) | Data 1 Pulse or Space Width ($\mu s$) |
|---|---|---|
| DirecTV<br>DirecTV Repeat | 600<br>(420-580) | 1170<br>(819-1521) |

SYSTEM AND METHOD FOR CAPTURING REMOTE CONTROL DEVICE COMMAND SIGNALS

CROSS REFERENCE TO RELATED APPLICATIONS

This document claims priority under 35 U.S.C. § 119(e) to U.S. Provisional Application Ser. No. 61/114,991, entitled "System and Method for Capturing Remote Control Device Command Signals," and filed by Rainer Brodersen, Stephanie Cinereski, and Jack I-Chieh Fu on Nov. 14, 2008, the entire disclosure of which is incorporated herein by reference.

TECHNICAL FIELD

The present disclosure relates to media processing devices, and to systems and methods for capturing by a media processing device remote control device command signals, such as navigation and playback commands, from a plurality of remote control devices.

BACKGROUND

Media processing devices can be configured to process and playback media content that contains audio, image, and/or video content. Playback of media content can be controlled through the input of commands, such as pause, rewind, and stop. Additionally, one or more menus associated with the media content, such as chapter or feature menus, can be traversed in a user interface in response to one or more input commands.

A media processing device can incorporate a user interface that includes one or more controls, such as buttons, switches, and dials. The controls can be actuated to input commands for directing playback and navigation. Further, some media processing devices can include a remote control device configured to transmit command signals, such as infrared (IR) or radio frequency signals, representative of commands entered using the remote control device. For example, a remote control device can include a plurality of controls, such as buttons and switches. A simple command can be indicated by a single control, such as a button push. Further, a complex command can be indicated by a combination of controls, such as simultaneous or sequential actuation of multiple buttons. Also, a brief actuation, such as a button push, can be distinguished from a continuous actuation, such as a button hold, and the corresponding command signals can be interpreted differently. For example, a control can be deemed to be actuated for as long as the command signal events are received within a predetermined time window, and the control can be deemed to be held if it is in a continuously actuated state for a predetermined amount of time. Each command signal transmitted by the remote control device can correspond to an action the media processing device is to perform.

A media processing device can be configured to recognize a predetermined set of command signals and can perform actions corresponding to the command signals transmitted by an associated remote control device. Also, universal remote control devices have been developed that can transmit command signals associated with a plurality of different command formats or protocols. Thus, a universal remote control device can be programmed to transmit commands corresponding to a plurality of remote control devices and can thereby control a plurality of media processing devices.

However, each media processing device responds only to the set of command signals it is configured to recognize.

SUMMARY

A media processing device, such as the AppleTV distributed by Apple Inc. of Cupertino, Calif., can be configured to recognize command signals transmitted by a primary remote control device corresponding to the media processing device and a plurality of secondary remote control devices. The secondary remote control devices can be remote control devices associated with other devices from the same manufacturer as well as third-party remote control devices. Further, the command signals can be transmitted using a plurality of different protocols and/or formats. Additionally, a media processing device can be configured such that multiple secondary remote control devices can be active at the same time. In order to permit the use of a secondary remote control device with a media processing device, the present inventors recognized that it was beneficial to permit the media processing device to map a command signal transmitted by the secondary remote control device to a function that can be performed by the media processing device.

The present inventors also recognized a need for a media processing device to map command signals associated with a secondary remote control device to at least each of the basic control functions that can be performed using the primary remote control device. Further, the need to map a media processing device function to any control included on a secondary remote control device also was recognized. Additionally, the present inventors recognized the need to provide an indicator, such as turning off a light emitting diode (LED), when the media processing device recognizes a command signal transmitted by a remote control device. Accordingly, the techniques and apparatus described here implement algorithms for recognizing and mapping by a media processing device one or more command signals transmitted by a secondary remote control device to functions that can be performed by the media processing device.

In some implementations, a method includes comparing characteristics of a wireless signal received from a remote control to characteristics associated with a set of protocols. The method also includes assigning a score, based upon the comparison, to each protocol included in the plurality of protocols. The method also includes identifying a protocol from the set of protocols based upon the assigned scores. The identified protocol is substantially similar to a protocol associated with the wireless signal.

In other implementations, a media processing device includes a receiver for receiving a wireless signal from a remote control. The media processing device also includes a remote control driver for comparing characteristics of the wireless signal to characteristics associated with a set of protocols. The remote control driver is configured to assign a score, based upon the comparison, to each protocol included in the set of protocols. The remote control driver is further configured to identify a protocol from the set of protocols based upon the assigned scores. The identified protocol is substantially similar to a protocol associated with the wireless signal.

In still other implementations, one or more computer readable media store instructions that are executable by a processing device, and upon such execution cause the processing device to perform operations that include comparing characteristics of a wireless signal received from a remote control to characteristics associated with a set of protocols. The operations also include assigning a score, based upon the comparison, to each protocol included in the set of protocols. Operations also include identifying a protocol from the set of protocols based upon the assigned scores. The identified protocol is substantially similar to a protocol associated with the wireless signal.

The techniques described in this specification can be implemented to realize one or more of the following advantages. For example, the techniques can be implemented such that a media processing device can be programmed to receive and recognize commands from a plurality of remote control devices, including secondary remote control devices. The techniques also can be implemented to permit mapping a control signal associated with any control of a secondary remote control device to a specific function of the media processing device. Further, the mappings corresponding to a secondary remote control device can be stored in a device profile. Additionally, the techniques can be implemented to permit renaming a remote control device profile stored on the media processing device, deleting a remote control device profile, or remapping at least a portion of a remote control device profile. The techniques also can be implemented such that one or more remote control device profiles are preloaded on the media processing device, such as for widely-used secondary remote control devices. The techniques further can be implemented to permit presenting an interface for guiding a user through the creation of a remote control device configuration.

The details of one or more implementations are set forth in the accompanying drawings and the description below. Other features and advantages will be apparent from the description and drawings, and from the claims.

BRIEF DESCRIPTION OF THE DRAWINGS

FIG. 10 is a table showing a variety of different protocols.

FIG. 11 is a table showing head pulse width ranges and header space width ranges that can be utilized for comparison with an IR signature.

FIG. 12 is a table showing expected pulse and space widths for phase encoding protocols.

Like reference symbols indicate like elements throughout the specification and drawings.

DETAILED DESCRIPTION

Figure 1:
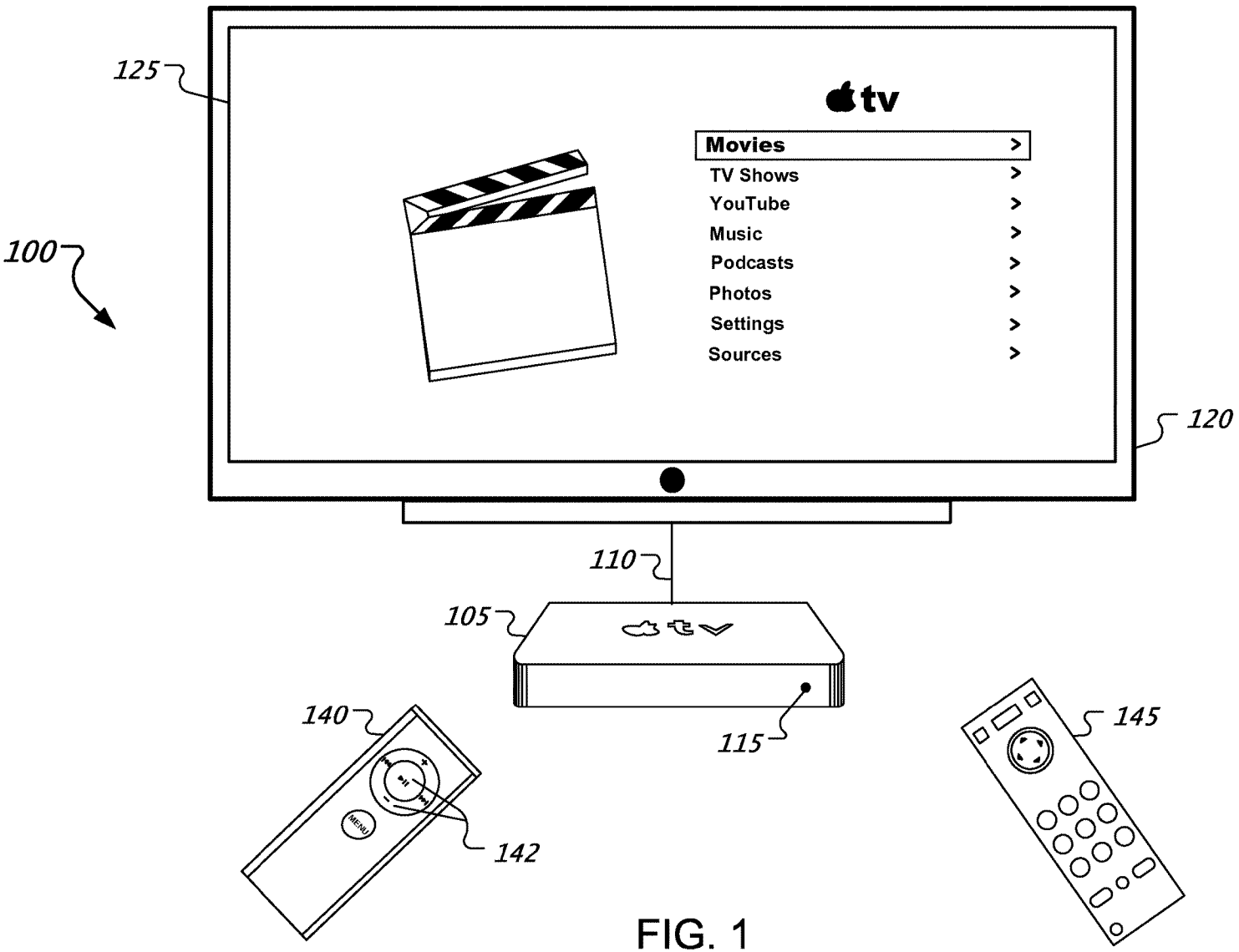
FIG. 1 shows an exemplary media system including a media processing device.

FIG. 1 shows an exemplary media system 100 including a media processing device 105. The media processing device 105 can be configured to process media content and to generate image, audio, and/or video output based on media content. For example, the media processing device 105 can be coupled to a display 120 through a media connection 110, which can be wired or wireless. Further, the media content can be stored local to the media processing device 105, such as on an internal storage device, an attached storage device, or removable media, including a digital versatile disc (DVD), a compact disc (CD), or a memory stick. Alternatively, the media content can be downloaded or streamed from a remote source over a network connection (not shown).

The media processing device 105 also can be configured to generate a user interface 125, which can be presented on the display 120. The user interface 125 can include one or more screens configured to receive input from a user. For example, the user interface 125 can be organized in a menu structure, including a main menu screen and one or more sub-menu screens. Further, the sub-menu screens can be organized using multiple levels, such that a sub-menu screen can include links to additional sub-menus screens. In some implementations, audio output can be used in conjunction with or in place of the user interface 125.

A main menu 130 of the user interface 125 can include a plurality of options relating to the media processing device 105, including options corresponding to media content categories, device settings, and media content sources. Other implementations of the main menu 130 can include additional, fewer, or different options. The user interface 125 also can include a movable cursor 135 that can be used to highlight a menu option. For example, the option "Movies" in the main menu 130 can be highlighted by the cursor 135 and then accessed in response to input received by the media processing device 105, such as a select command. Further, the cursor 135 can be repositioned within the user interface 125 in response to navigation input received by the media processing device 105, such as directional commands.

In some implementations, input can be provided to the media processing device 105 through one or more incorporated controls (not shown). Further, the media processing device 105 can include one or more sensors and/or antennas configured to detect signals transmitted by a remote control device, including infrared sensors. A primary controller 140 can be associated with the media processing device 105. The primary controller 140 can include a plurality of controls 142, such as buttons and switches, for receiving simple and complex commands from a user. Further, the primary controller 140 can be configured to transmit command signals corresponding to a received command to the media processing device 105, such as via infrared or radio-frequency transmission. The media processing device 105 can detect the transmitted command signals and interpret the transmission protocol used. Further, the media processing device 105 can convert a command signal received from the primary controller 140 into message identifying one or more functions to be performed.

Further, the media processing device 105 can be configured to detect command signals transmitted by a plurality of secondary controllers, such as the secondary controller 145. A secondary controller can be a controller associated with another device provided by the same manufacturer or a third-party controller. The media processing device 105 can be configured to identify the protocol used by the secondary controller 145 to transmit the command signals. For example, the media processing device 105 can be configured to generate a signature representing a received command signal. The signature format can be structured to accommodate a plurality of different transmission protocols. Further, the signature can be analyzed using matching heuristics to identify the protocol used to transmit the command signal. Once the transmission protocol has been identified, the command signal can be interpreted in accordance with the identified protocol to extract the message being communicated. The extracted message can be encoded in digital form and processed by the media processing device 105.

Additionally, a light emitting diode (LED) 115 can be included on a visible portion of the media processing device 105, such as the front face. The default state of the LED 115 can be illuminated when the media processing device 105 is powered on. When a command signal is received from a controller, the media processing device 105 can analyze the command signal to determine whether it can be recognized. If the command signal is recognized as a command to which the media processing device 105 has been programmed to respond, the LED 115 can be turned off. In some implementations, the LED 115 can remain off for the duration of the command signal. Thus, the LED 115 can provide a visual indication that a recognized command is being received. Alternately, if the command signal is unrecognized, such as an infrared transmission from a source that has not been learned, the LED 115 can remain illuminated.

The media processing device 105 can operate in a command interpretation mode, in which command signals received by the media processing device 105 are evaluated to determine whether they are recognized. For example, an infrared signal detected by a sensor of the media processing device 105 can be evaluated against one or more known (or learned) command signals to determine whether there is sufficient identity. If a received command signal is recognized, it can be executed by the media processing device 105. Alternatively, a received command signal can be ignored if it is not recognized.

The media processing device 105 also can operate in a learning mode, in which command signals transmitted by a remote control device are captured and mapped to a corresponding function. For example, in learning mode, the media processing device 105 can instruct a user to actuate a control on the remote control device being learned that corresponds to a particular function. The media processing device 105 can capture and buffer the command signal received by the sensor for a predetermined period of time, such as 2 seconds. The buffered command signal can then be analyzed to identify one or more characteristics. For example, the media processing device 105 can determine whether the buffered command signal was consistent for the entire period of time and whether the signal includes an initial message and one or more repeat messages. Further, one or more timing characteristics of the buffered command signal also can be analyzed, such as the maximum time between events. The media processing device 105 can then store the identified characteristics for use in identifying command signals while in command interpretation mode.

Figure 2:
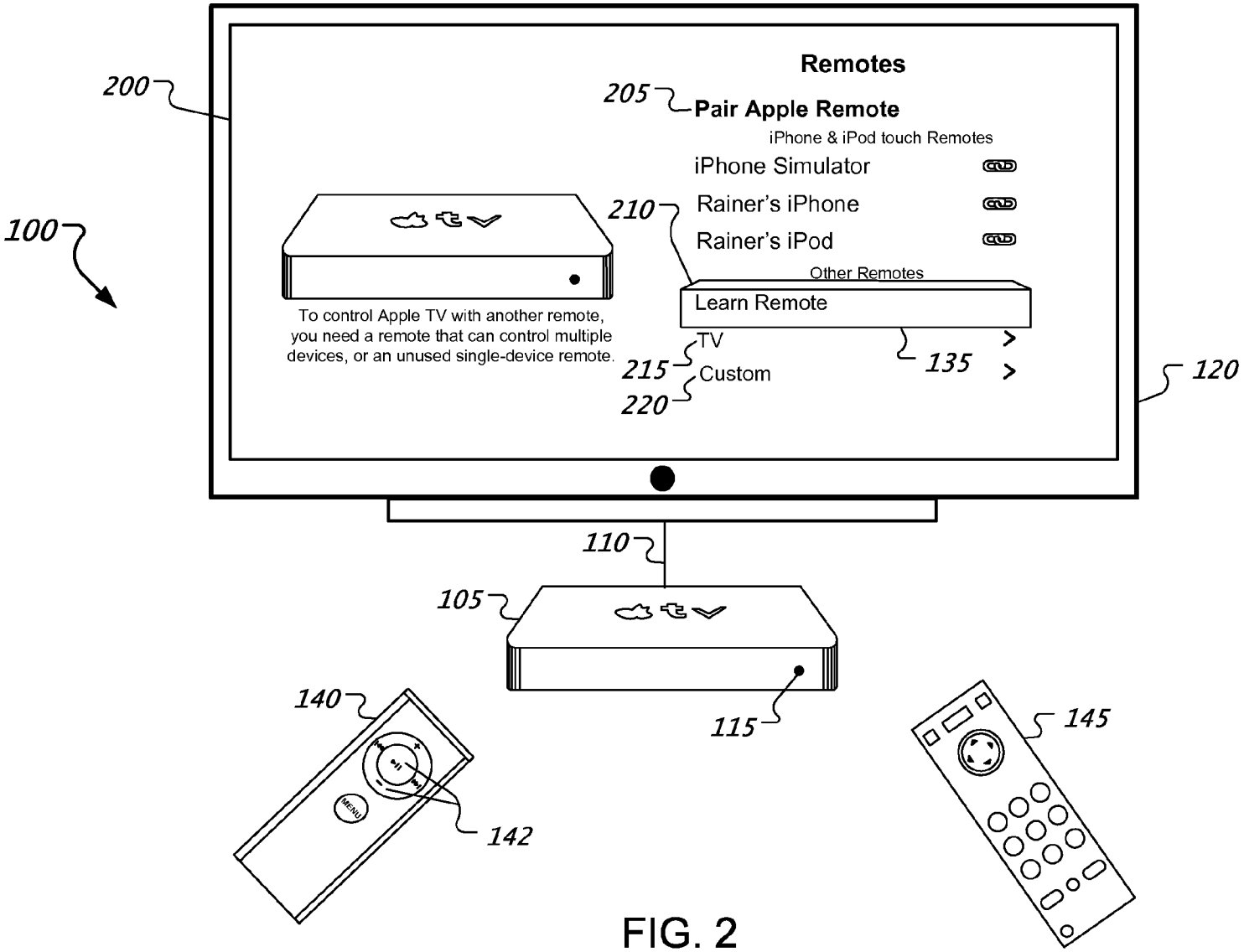
FIGS. 2-5 show exemplary interfaces presented by a media processing device.

FIG. 2 shows an exemplary remote control interface 200 presented by the media processing device 105. The remote control interface 200 can include one or more options associated with the primary controller 140, such as a Pair Remote option 205 for pairing the primary controller 140 with the media processing device 105. Once paired, the media processing device 105 responds only to command signals received from the paired controller. In some implementations, the remote control interface 200 can include an option to unpair the primary controller 140 after it has been paired.

The remote control interface 200 also can include options associated with one or more secondary remote controllers. Any option included in the remote control interface 200 can be accessed using the cursor 135. For example, the remote control interface 200 can include a learn remote option 210, which can be accessed to permit the media processing device 105 to learn command signals associated with an additional controller, such as the secondary controller 145. Further, the remote control interface 200 can include options to access stored profiles corresponding to secondary remote controllers, such as the TV remote 215 and the Custom remote 220. A stored profile can be accessed to perform one or more management tasks with respect to that profile. For example, a stored profile can be accessed to perform functions such as renaming the profile, deleting the profile, or modifying the profile by remapping one or more commands.

Figure 3A:
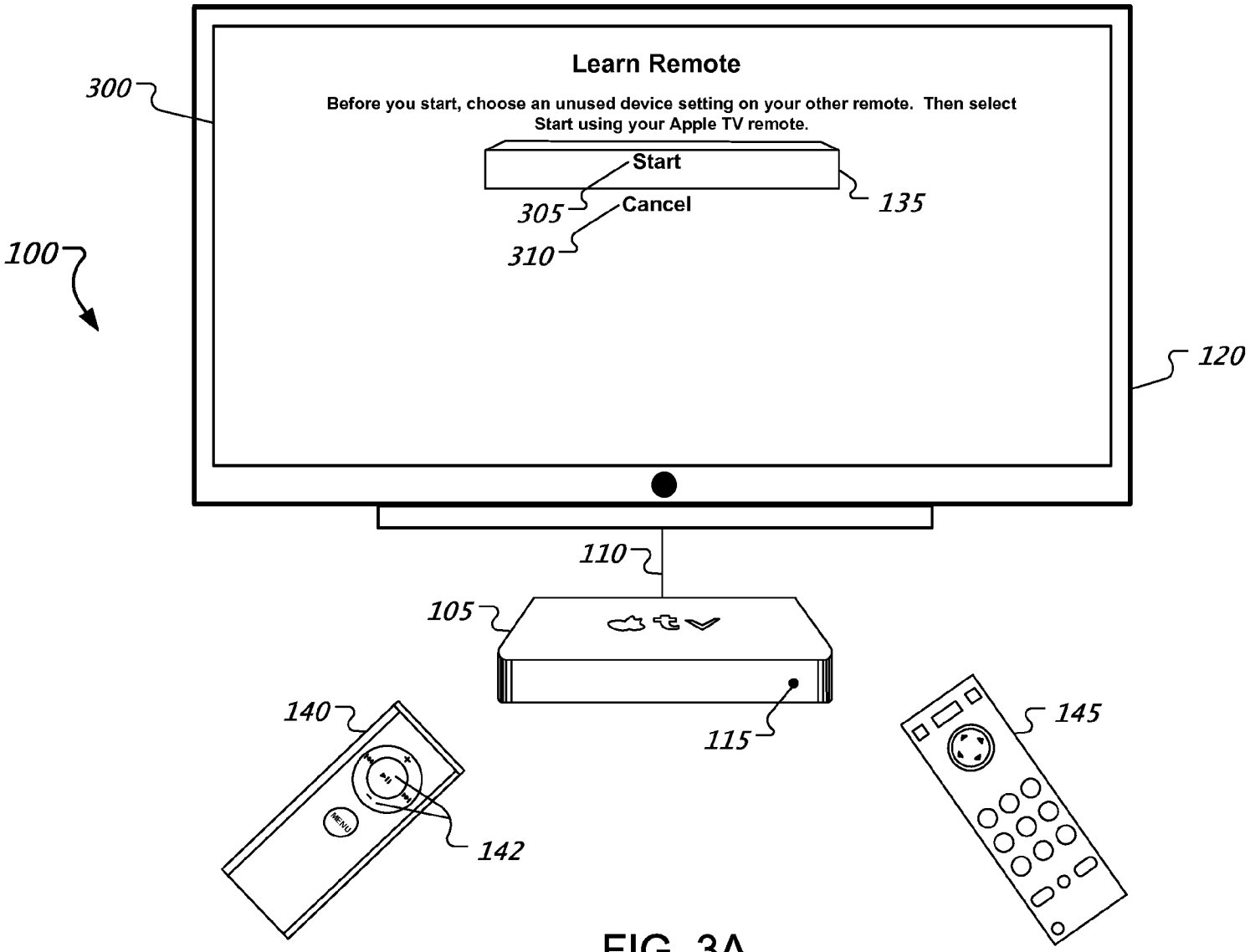

FIG. 3A shows an exemplary learn remote interface 300 presented by the media processing device 105. The learn remote interface 300 can be presented in response to selection of the learn remote option 210 in the remote control interface 200. The learn remote interface 300 can include a list of options that can be highlighted using the cursor 135, such as a start option 305 and a cancel option 310. The learn remote interface 300 can include additional, fewer, or different options in other implementations. Accessing the start option 305 can cause the media processing device 105 to switch from the command interpretation mode to the learning mode. Alternatively, accessing the cancel option 310 can cause the media processing device 105 to exit the learn remote interface 300.

Figure 3B:
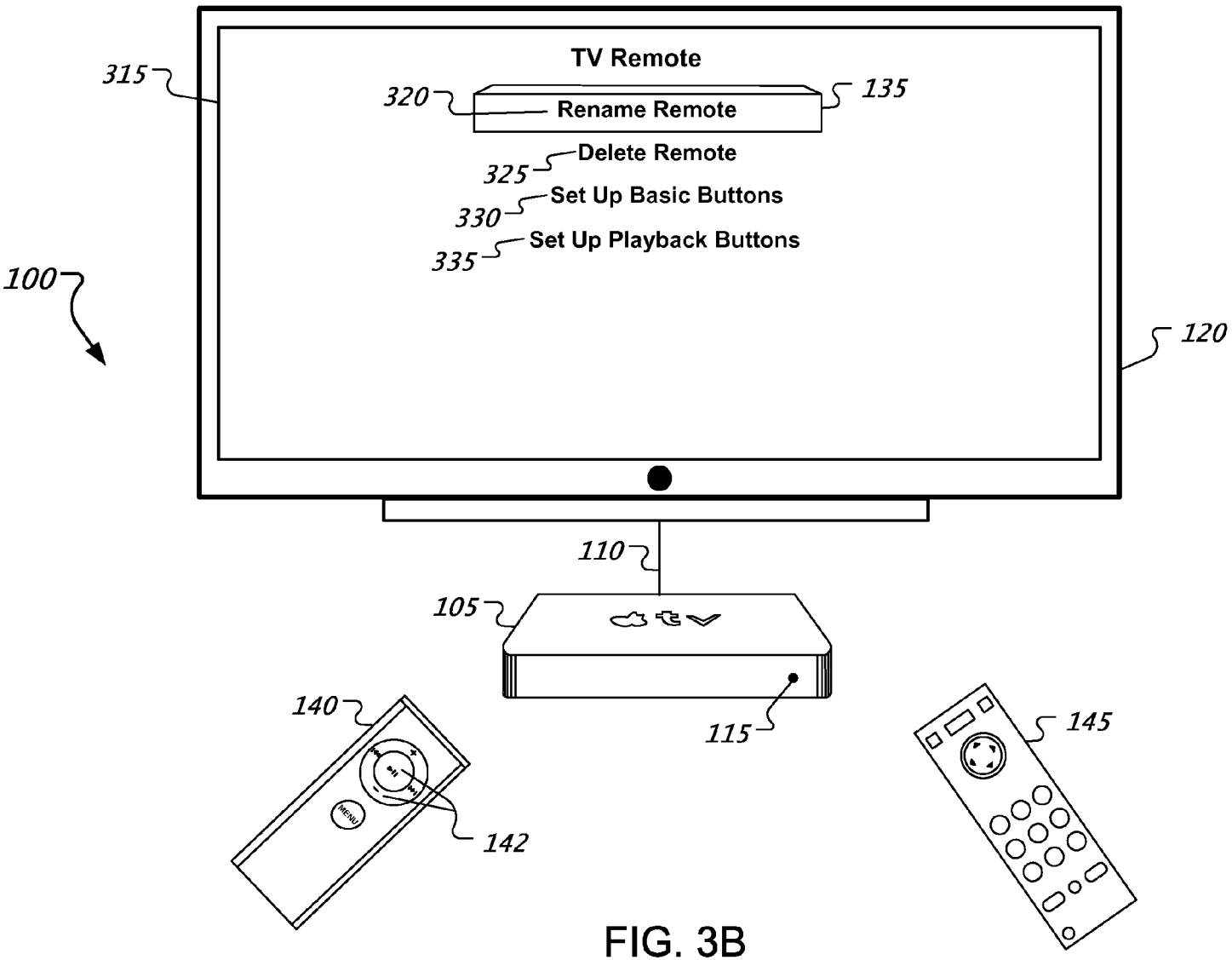

FIG. 3B shows an exemplary stored profile interface 315 presented by the media processing device 105. The stored profile interface 315 can be presented in response to selection of an option to access a stored profile, such as in the remote control interface 200. The stored profile interface 315 corresponds to the profile named TV Remote and represents a secondary controller configured to operate with the media processing device 105. A plurality of management options for the TV Remote profile can be accessed through the stored profile interface 315. For example, a rename remote option 320 can be accessed to change the name of the TV Remote profile. A delete remote option 325 also can be accessed to delete the stored TV Remote profile. Further, the mapping between one or more controls of the secondary controller identified as TV Remote and one or more functions of the media processing device 105 can be configured or modified, such as through the Set Up Basic Buttons option 330 and the Set Up Playback Buttons option 335. For example, an unmapped function can be mapped to a control or a previously mapped function can be remapped to a different control.

Figure 4:
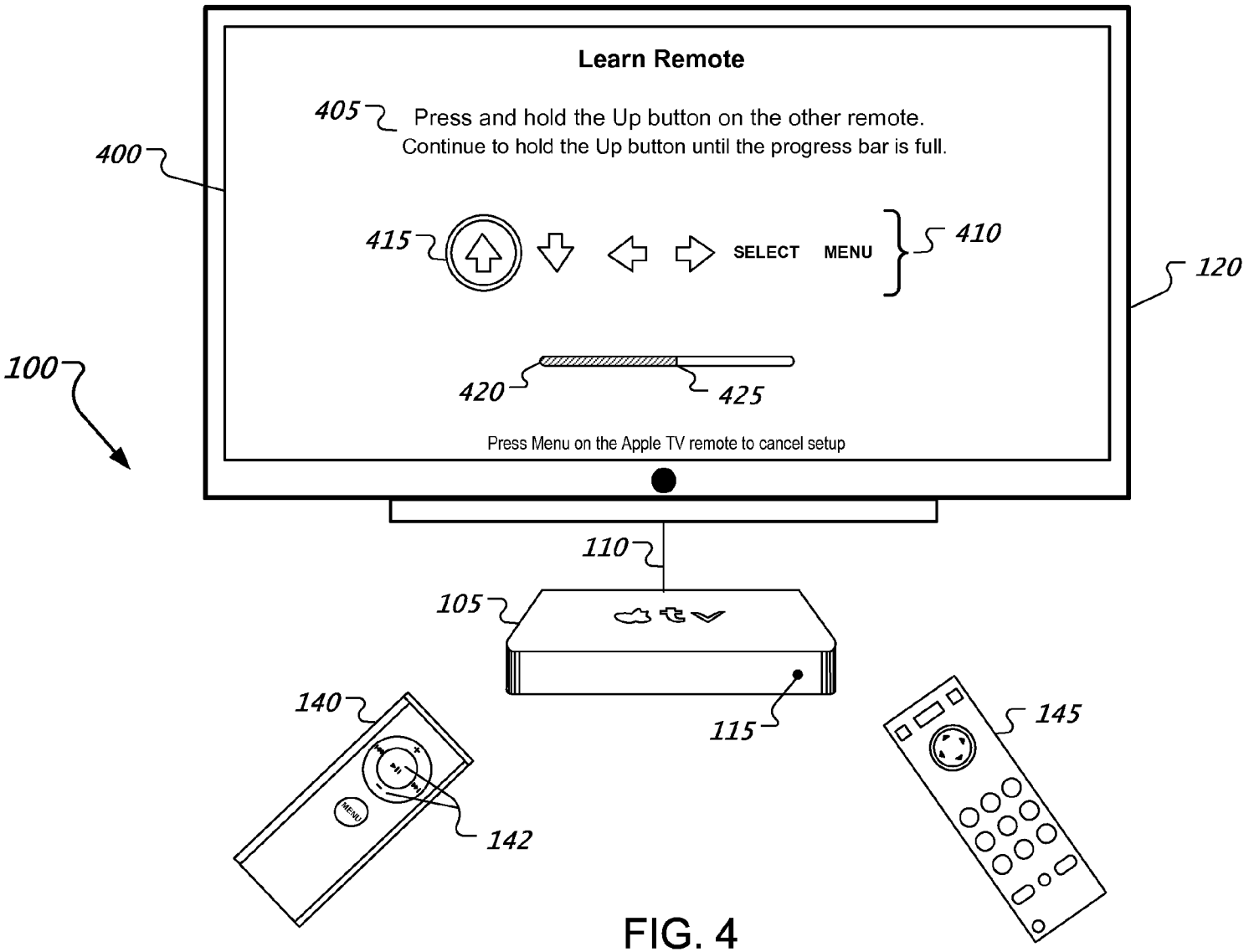

FIG. 4 shows a basic button interface 400 presented by the media processing device 105. The basic button interface 400 can be presented in response to input accessing the start option 305 of the learn remote interface 300. The basic button interface 400 includes instructions 405 indicating which control is to be actuated on the secondary controller being learned, such as the secondary controller 145. For example, if the UP navigation button is being mapped to a corresponding command signal, the message "Press and hold the Up button on the other remote. Continue to hold the Up button until the progress bar is full." can be displayed. However, any control can be designated as the Up button. For example, if the secondary controller 145 does not include an Up button, a different control that will not be mapped to any other media processing device 105 function can be designated. In some implementations, an audio instruction can be presented in conjunction with or in place of the on-screen instructions 405.

The basic button interface 400 also can display a plurality of control button symbols 410. In some implementations, a control button symbol 410 can be a graphical representation of a control to be actuated. Each of the control button symbols 410 represents a function performed by the media processing device 105 that is to be mapped to a control of the secondary controller being learned. For example, the control button symbols 410 can include UP, DOWN, LEFT, and RIGHT navigation arrows. The control button symbols 410 further can include identifiers corresponding to the SELECT and MENU functions. Other implementations can include additional, fewer, or different control button symbols 410.

A cursor 415 can be presented in the basic button interface 400 to indicate which of the control button symbols 410 is presently being mapped to a control of the secondary controller. The cursor 415 can be automatically repositioned to the next control button symbol 410 as the mapping process is executed. Alternatively, the cursor 415 can be manually positioned to select a control button symbol 410 corresponding to the control to be mapped. In some implementations, the control button symbols 410 can be visually differentiated to distinguish the control buttons that have been mapped from those that have not. For example, each of the control button symbols 410 that have been mapped can be shaded, grayed, made transparent, or otherwise visually differentiated.

Additionally, the basic button interface 400 can display a progress bar 420 to indicate the duration for which the control button being mapped should be depressed on the secondary controller. A progress indicator 425 can fill the progress bar 420 both to indicate a degree of completeness and to signal when the control button can be released. For example, the progress indicator 425 can fill the progress bar 420 over a predetermined period, such as two seconds. Alternatively, the period over which the progress indicator 425 fills the progress bar 420 can vary based on the command signals received by the media processing device 105. For example, filling any portion of the progress bar 420 can be delayed until after a command signal is detected by the media processing device 105. Once the progress indicator 425 has completely filled the progress bar 420, the cursor 415 can be advanced to the next control button symbol 410 and the progress bar 420 can be reset. Once the basic buttons of the secondary controller 145 have been mapped, the secondary controller 145 can be used to control the media processing device 105.

In some implementations, one or more pre-learned profiles that include the command signals of a secondary controller can be stored on the media processing device. For example, data representing the command signals of an ACME DVD player remote control can be stored on the media processing device at the time of manufacture or as part of a software update. When the media processing device is in learning mode, one or more received command signals, e.g., the first and second command signals, can be compared with the pre-learned profiles to determine whether there is sufficient identity. If one or more received command signal sufficiently match data stored in a pre-learned profile, the media processing device can present a message offering automated configuration of the secondary controller. For example, the media processing device can output the message "You appear to be using an ACME DVD remote. Would you like me to set up your buttons automatically?" If the user elects, the pre-learned profile can be used to automatically generate the remote profile corresponding to the secondary controller.

Figure 5:
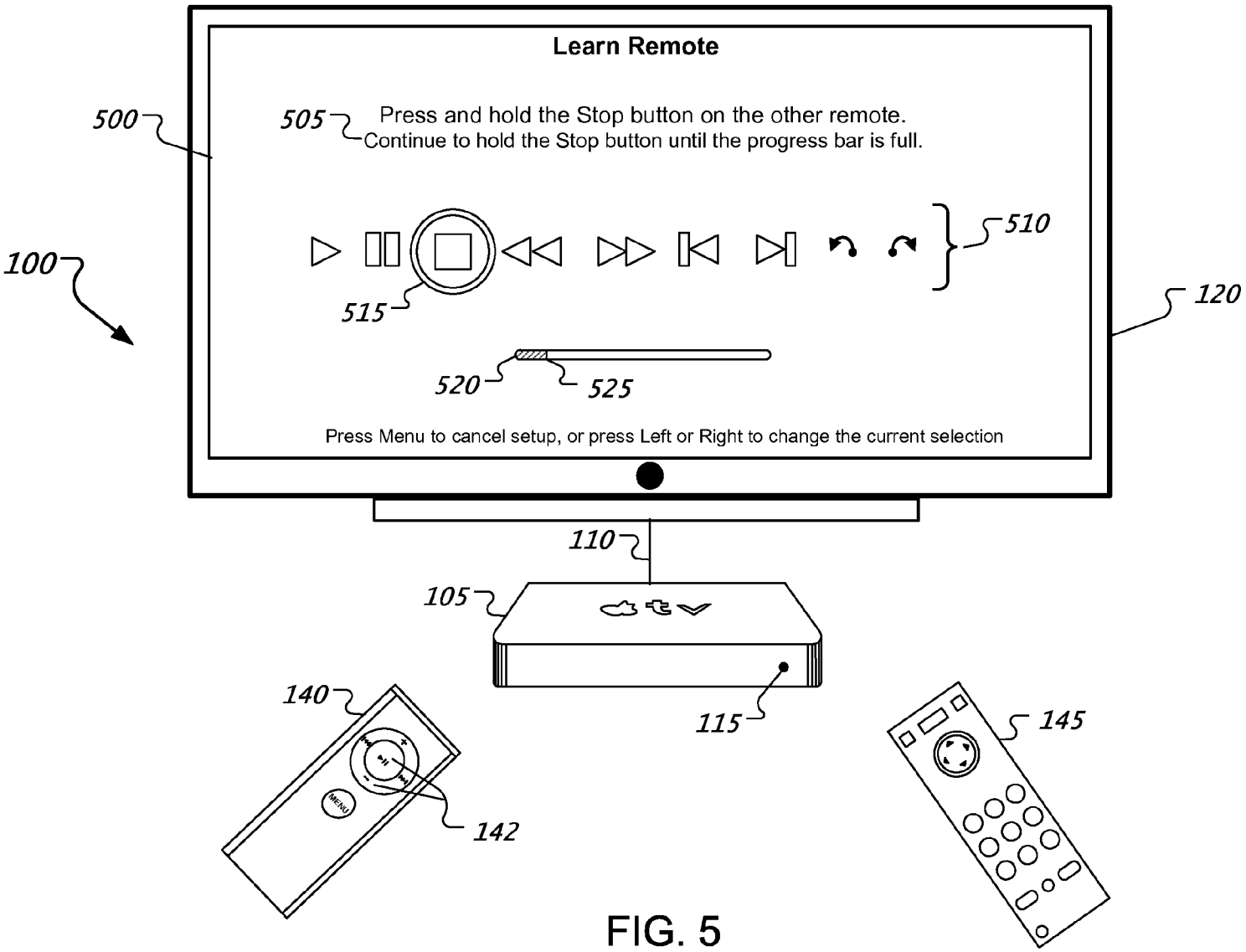

FIG. 5 shows a playback button interface 500 presented by the media processing device 105. In some implementations, the playback button interface 500 can be automatically presented after configuration in the basic button interface 400 has been completed. The playback button interface 500 includes instructions 505 indicating which playback control is to be actuated on the secondary controller being learned, such as the secondary controller 145. For example, if the STOP playback function is being mapped to a corresponding control and command signal, the message "Press and hold the Stop button on the other remote. Continue to hold the Stop button until the progress bar is full." can be displayed. However, any control can be designated as the Stop button. For example, if the secondary controller 145 does not include a Stop button, a different control that will not be mapped to any other media processing device 105 function can be designated. In some implementations, an audio instruction can be presented in conjunction with or in place of the on-screen instructions 405.

The playback button interface 500 also can display a plurality of playback button symbols 510. Each of the playback button symbols 510 represent a function performed by the media processing device 105 that is to be mapped to a control of the secondary controller being learned. For example, the playback button symbols 510 can include PLAY, PAUSE, STOP, REWIND, FAST FORWARD, CHAPTER SKIP BACKWARD, CHAPTER SKIP FORWARD, REPLAY and SKIP FORWARD. The REPLAY and SKIP FORWARD functions can be configured to rewind or advance playback by a predetermined amount of time, such as 10 seconds. Other implementations can include additional, fewer, or different playback button symbols 510.

A cursor 515 also can be presented in the playback button interface 500 to indicate which of the playback button symbols 510 is presently being mapped to a control of the secondary controller. The cursor 515 can be automatically repositioned to the next playback button symbol 510 as the mapping process is executed. Alternatively, the cursor 515 can be manually positioned to select a playback button symbol 510 corresponding to the playback symbol to be mapped. In some implementations, the playback button symbols 510 can be visually differentiated to distinguish the control buttons that have been mapped from those that have not. For example, each of the playback button symbols 510 that have been mapped can be shaded, grayed, made transparent, or otherwise visually differentiated.

Additionally, the playback button interface 500 can display a progress bar 520 to indicate the duration for which the control button being mapped should be depressed on the secondary controller. A progress indicator 525 can fill the progress bar 520 both to indicate a degree of completeness and to signal when the control button can be released. For example, the progress indicator 525 can fill the progress bar 520 over a predetermined period, such as two seconds. Alternatively, the period over which the progress indicator 525 fills the progress bar 520 can vary based on the command signals received by the media processing device 105. For example, filling any portion of the progress bar 520 can be delayed until after a command signal is detected by the media processing device 105. Once the progress indicator 525 has completely filled the progress bar 520, the cursor 515 can be advanced to the next playback button symbol 510 and the progress bar 520 can be reset.

Figure 6:
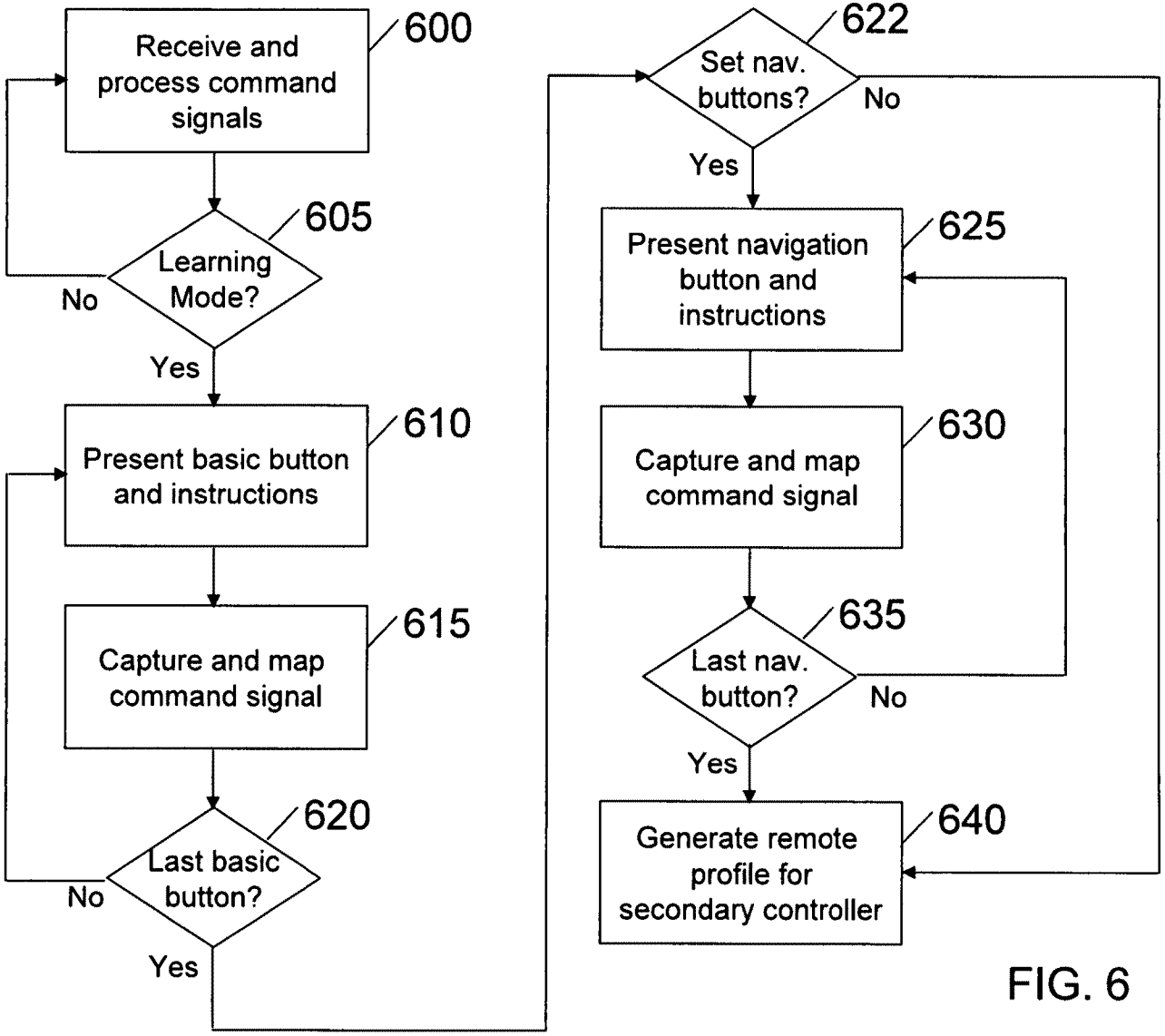
FIG. 6 shows a flow diagram describing an exemplary process for detecting and learning command signals.

FIG. 6 shows a flow diagram describing an exemplary process for detecting and learning command signals. A media processing device can be configured to detect command signals transmitted wirelessly, such as infrared or radio frequency signals. The command signals can indicate a simple command or a complex command. Also, the command signals can indicate a single control actuation versus a continuous control actuation, e.g., a control that is held. Further, the media processing device can be configured to interpret command signals that are transmitted using a plurality of different transmission protocols. The media processing device can receive and process command signals in a command interpretation mode (600). For example, a sensor associated with the media processing device can receive a command signal and pass a representation of the received command signal to a command recognition module, which can be implemented in software, hardware, or a combination thereof. The command recognition module can determine what protocol was used to transmit the command signal and whether that protocol is supported by the media processing device. If the protocol is supported, the command signal can be interpreted and executed. Otherwise, the command signal can be ignored.

Further, the media processing device can determine whether the remote control learning mode has been selected (605). For example, one or more options can be selected in a user interface to invoke the remote control learning mode. The remote control learning mode can be invoked from any supported input device, including a secondary controller for which the basic button configuration has been completed. The remote control learning mode can be used to learn the command signals associated with particular controls of a secondary controller. If the command signal is not instructing the media processing device to enter the learning mode, the media processing device continues to receive and process command signals in the command interpretation mode (600). If the command signal instructs the media processing device to enter the learning mode, the media processing device can present a basic button to be learned and one or more instructions (610). For example, the media processing device can present a basic button interface, as shown in FIG. 4, indicating a basic button of the secondary controller to be mapped and instructing a user to perform one or more actions, such as actuating a specific control for a period of time.

The media processing device can capture a command signal transmitted by the secondary controller and map the captured command signal to a basic function performed by the media processing device (615). For example, the media processing device can buffer the command signal received after the user has been instructed to actuate a specific control associated with the secondary controller. The command signal can be buffered for a predetermined period of time, such as 2 seconds. Alternatively, the command signal can be buffered for a variable period of time, such as based on one or more characteristics of the received command signal. Further, a visual indicator, such as a progress bar, can be presented to inform the user when to actuate and when to release the control of the secondary controller.

Once the command signal has been buffered, the media processing device analyzes the buffered signal. For example, the media processing device can determine whether the buffered command signal is consistent over time. The media processing device also can determine whether the buffered command signal includes an initial message and one or more repeat messages. Further, timing information associated with the buffered command signal also can be analyzed. For example, the maximum time between events in the buffered command signal can be determined, such as for use in identifying a minimum period between different commands. In some implementations, the received command signal data will be discarded if the signal is interrupted before the predetermined capture period of time expires. After the command signal transmitted by the secondary controller has been analyzed, a representation of the command signal can be stored using a number of parameters. For example, the parameters can indicate an initial message or pattern associated with the command signal, any repeat packet associated with the command signal, and a time interval between events that make up the command signal. In some implementations, if the buffered command signal cannot be processed or is defective, the media processing device can repeat the capture operation for the associated control.

In some implementations, the media processing device can be configured to store one or more pre-learned profiles that include the command signals of a secondary controller. The media processing device can automatically generate a remote profile for a secondary controller if a received command signal sufficiently matches data included in a pre-learned profile. If automatic generation of the remote profile is selected, the learning mode can be canceled and the media processing device can return to command interpretation mode.

After the command signal associated with a basic button has been captured, the media processing device can determine whether all of the basic buttons have been processed (620). If the command signal corresponding to one or more basic buttons has not been captured, the media processing device can present the next basic button to be learned and one or more associated instructions (610). Otherwise, the media processing device can determine whether one or more navigation controls are to be learned (622). For example, the media processing device can present an interface requesting input from a user to either exit configuration of the secondary controller or to learn one or more navigation controls. The secondary controller can be used to control the media processing device after the basic buttons have been configured. Thus, configuration of one or more navigation controls can be optional. If one or more navigation controls are to be configured, the media processing device can present a navigation button to be learned and one or more associated instructions (625). For example, the media processing device can present a navigation button interface, as shown in FIG. 5, indicating a navigation button of the secondary controller to be mapped and instructing a user to perform one or more actions. Otherwise, the media processing device can generate a remote profile for the secondary controller (640). For example, the remote profile can include data for recognizing and interpreting one or more command signals transmitted by the secondary controller that correspond to the configured basic controls.

If one or more navigation controls are to be configured, the media processing device can capture a command signal transmitted by the secondary controller and map the captured command signal to a navigation function performed by the media processing device (630). The media processing device can capture and process a command signal corresponding to a navigation button in the same manner as the command signal for a basic button. After the command signal associated with the navigation button has been captured, the media processing device can determine whether all of the navigation buttons have been processed (635). If a command signal corresponding to one or more navigation buttons has not been captured, the media processing device can present the next navigation button to be learned and one or more associated instructions (625). Otherwise, the media processing device can generate a remote profile for the secondary controller (640). The remote profile can be named, such that the associated secondary controller can be identified. Further, the remote profile can include data for recognizing and interpreting one or more command signals transmitted by the secondary controller. In some implementations, the data can be structured so that it is at least ninety-nine percent repeatable by the same control of the same secondary controller.

Figure 7:
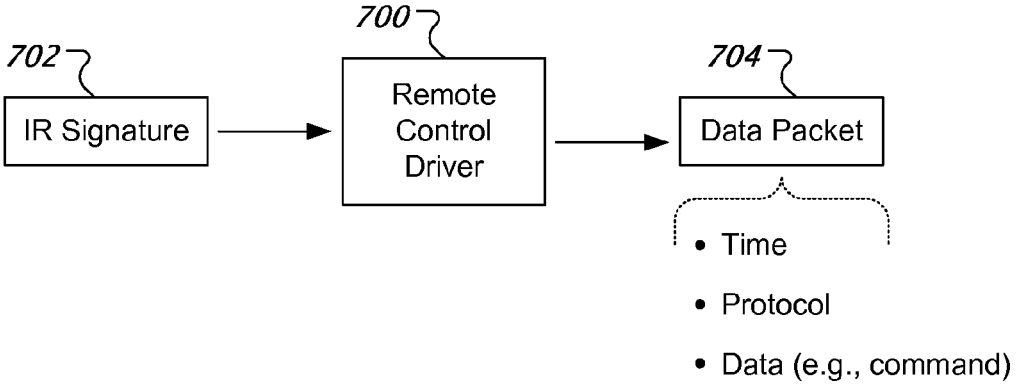
FIG. 7 shows an exemplary remote control driver that can be executed by the media processing device.

FIG. 7 shows an exemplary remote control driver 700 that can be executed by the media processing device 105. In general, an IR signature 702 received by the media processing device 105 is provided to the driver 700 for source identification (e.g., the remote control type). If the source is unidentifiable, the remote control driver 700 attempts to extract characteristics of the signature for classifying the signature source. As such, the learned characteristics can be stored and later used for recognizing a reoccurrence of a similar IR signature.

For the scenario in which a recognizable protocol is being carried by the IR signature 702, in this arrangement, the remote control driver 700 produces one or more data packets (e.g., illustrated with an exemplary data packet 704) that contain information decoded from the IR signature 702. For example, data representing timing information, the identified protocol, and data embedded within the IR signature (e.g., a command) may be included in the data packet 704.

By comparing information from the IR signature 702 with information of known protocols, a heuristic technique may be provided for determining various possible protocols that may be used by the IR signature 702. Along with protocols associated with one or more IR transmissions standards, standards associated with particular corporations and products may be identified. For example, protocols associated with NEC, Sharp, Sony (e.g., Sony SIRC), Philips (e.g., Philips RC-5, Philips RC-6), JVC, Samsung, Hitachi, Mitsubishi, DirecTV and other similar entities may be detected. Protocols associated with particular countries (e.g., Japan, United States) and/or global regions (e.g., Europe) may also be identified.

In some instances, IR signatures that implement particular protocols (e.g., NEC, DirecTV, JVC protocols) may dynamically change. For example, signature properties may be change based upon subsequent pressing of buttons on a remote control. As such an IR signature associated with the first depressing of a remote button may have properties that change with the subsequent pressing (or depressing) of another remote button. In some arrangements, the remote control driver 700 may treat each received signature independently and attempt to identify an corresponding protocol.

Upon receiving the IR signature 702, the remote control driver 700 assigns a score (or multiple scores) to each known protocol. By comparing stored data (e.g., stored in the media processing device 105) of previously known protocols with information attained from the received IR signature, each protocol score provides a measure of how closely the properties of that protocol resemble the properties of the received signature. Various scoring techniques and methodologies may be implemented by the remote control driver 700. For example a set of sub-scores (e.g., three sub-scores), each of which is associated with a protocol property, may be assigned to each protocol. Based upon the sub-scores, the protocol of the received IR signature may be identified (or trigger the learning of a previously unknown protocol).

In one arrangement, the three sub-scores may be associated with the number of pulses in the signature (referred to as the pulse count score), header information (referred to as the header score) and information associated with the data embedded in the signature (referred to as the data score). Upon attaining each score, additional processing may be executed (e.g., summing of the three sub-scores) to calculate an overall comparison metric for the protocols. In some arrangements, the sub-scores may be prioritized for the comparisons, for example, the pulse count score and the header score may be given a heavier weight for identifying the protocol of the IR signature 702. The pulse count of the received signature 702 and a known protocol may need to be equal to indicate a protocol match (e.g., to assure accurate translations). Additionally, protocol headers may be considerably distinct (e.g., in length and content), while the data score may be less reliable for identifying protocols (rather than just confirming identification). As such, the pulse count score and the header score may be more heavily weighted compared to the data score. In some arrangements sub-scores may have negative or zero values. Thereby, the total score may have a negative value. As such, the existence of some features in an IR signature may cause some protocols to fall out of the running altogether. For example, the NEC format requires a header of a particular size. If that particular header size is not found, the NEC format may not be considered at all.

Predefined thresholds may also be used by the remote control driver for protocol identification. For example, thresholds that represent minimum acceptable sub-scores may be implemented. In one arrangement, a minimum pulse count and header scores may be considered standard. As such, a constant minimum threshold may need to be attained for each of these scores. The processed scores (e.g., the sum of the pulse count score, the header score and the data score) may also be held to a particular minimum threshold.

Once the scores have been calculated to provide a comparison of the received IR signature 702, the highest scoring protocol (which also meets the minimum threshold) is considered to be a match to the signature. Based upon the match being detected, the data packet 704 (or multiple data packets) are produced to provide the encoded data (e.g., one or more commands) to the media processing device 105.

In regards to pulse count scoring, the received IR signature 702 is segmented into time intervals (e.g., converting bytes into time intervals) to allow the pulses of the signature to be counted. In general the first time interval is considered a pulse and may be counted as a pulse. Based upon the pulse count, each protocol is assigned a score.

Figure 8:
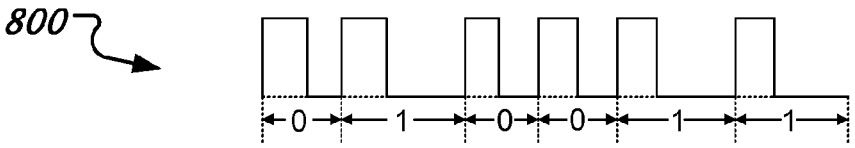
FIG. 8 shows an exemplary pulse series representing a pulse distance encoding protocol in which each pulse-space pair represents a single data bit.

Some protocols may use pulse distance encoding (PDE), in which pulses, and spaces between pulses, can have variable lengths. Referring to FIG. 8 a pulse series 800 represents a PDF protocol in which each pulse-space pair represents a single data bit (i.e., a logic 0 or 1). Utilizing this type of protocol, the number of pulses corresponds directly to the number of data bits in the encoded command. As such, to receive a matching pulse count score, the expected number of pulses for the PDE protocol needs to match the number of pulses included in the received IR signature.

Figure 9:
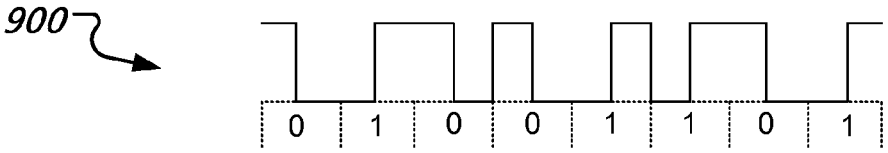
FIG. 9 shows an example of phase encoding that may be implemented in a pulse series.

Other types of encoding may also be implemented by the protocols. Referring to FIG. 9, for example, phase encoding (PE) may be implemented in a pulse series 900, however, such a encoding scheme may not provide an accurate pulse count (e.g., compared to an PDE protocol). In PE, a pulse is shifted to either the first half or the second half of a data bit to represent a logic 1 or 0. For this particular encoding scheme, an IR signature typically has a maximum number of pulses, however, less than the maximum number of pulses are typically needed to represent encoded commands. For example, in a somewhat extreme case, approximately half of the maximum number of pulses are needed to represent a command. As such, to receive a matching score for a PE protocol, the number of IR signature pulses needs to fall within a range of pulse counts.

Referring to FIG. 10, a table 1000 includes a series of entries for a variety of different protocols. For each protocol, a pulse count is provided in a one column along with an indication if phase encoding is implemented (in a second column). As represented in the table 1000, some of the protocols have multiple pulse counts that are acceptable, to indicate commands of different lengths. When scoring PDE protocols, if the pulse count of the IR signature matches any of the multiple pulse counts that are acceptable, the protocol is given a matching score.

For header scoring, the remote control driver 700 reviews the initial time intervals (e.g., first two intervals) of the received IR signature. As is typical with many protocols, a header can be identified within this initial interval. For example, a header may be identified from the pulse width of one or more pulses (e.g., the first pulse-space pair) within the initial interval. Pulse widths that represent headers are significantly longer than pulse contains in other portions of the IR signature. In general, pulse and space widths are associated with a tolerance (e.g., 30%). As such, intervals of the IR signature are compared to width ranges. If the first pulse of the IR signature falls within a protocol head pulse width range, the protocol receives a matching head score. Correspondingly, if the first space of the IR signature falls within the protocol header space width range, the protocol receives a matching header space score. Referring to FIG. 11, a table 1100 provides head pulse width ranges and header space width ranges that can be utilized by the remove control driver 700 for comparing with an IR signature and to score the corresponding listed protocols. In some situations, a protocol may be encountered that is absent a defined header. A header score may still be determined for such protocols, for example, based on the length of the IR signature first pulse and first space. However, rather than comparing the lengths to expected header widths, the first pulse and first space lengths are compared to the expected data pulse and space lengths associated with the protocol.

To provide a data score for each protocol, the remote control driver 700 compares the data portion of the received IR signature to corresponding data parameters for each protocol. For such scoring, the time interval data may be scored one pulse-space pair at a time. The minimum acceptable data score for an IR signature is based upon the number of pulses included in the signature. Since every pulse contained in the signature is not a data bit (e.g., a header pulse, a stop pulse, etc.), such potential non-data pulses are subtracted prior to determining the minimum acceptable score. For example, a minimum acceptable score may be calculated as:

$$\text{Score}=10*(\text{IR signature pulse count}-\text{possible non-data pulses})$$

and a matching score may be assigned based upon the number of data bits (e.g., a value of 10 per data bit).

Other parameters may also be incorporated into the data score. For example, the ability for a pulse-space pair to be translated into a logic 1 or 0 may add an incremental positive sub-score to a particular protocol. Therefore, if the driver 700 detects a repeated sequence of pulse-space pairs that can be translated into the NEC format, the score for that format would be increased. Typically, data scoring (including data translation) initiates with the second pulse of a signature (if a header has been identified). In such situations, the first pulse is considerably extended in time (e.g., longer than 1600 μs). If no header is present, data scoring (including translation) initiates with the first pulse.

As mentioned above, PDE is often utilized by the majority of protocols. For such protocols, data translation can be measured, for each pulse-space pair, by comparing the pulse width and the space width to the expected widths for a logic 0 data bit and a logic 1 data bit. Similar to the header pulse and space widths, data pulse and space widths for such protocols have an estimated tolerance (e.g., 30%). As such, the time intervals of the IR signature are compared to predefined ranges for each protocol. Referring to FIG. 12, a table 1200 provide entries for a various PDE protocols and the corresponding pulse and space width estimates for logic 0 and logic 1 values.

Some protocols (e.g., the NEC Repeat protocol and the Hitachi Repeat protocol) are absent a data portion and may only include a header and a single pulse (referred to as a stop pulse). For such protocols, the stop pulse has a predefined length (e.g., 560 μs). As such, if the second and last pulse of an IR signature falls within the tolerance range of the predefined length (e.g., 560 μs), the data score may also be increased for these protocols. In addition, for an IR signature to be matched to such "repeat" protocols, the previously received IR signature needs to have been identified as a similar type protocol. For example, the NEC Repeat protocol is considered as being matched only if the previous packet matched the NEC protocol. If such a situation has occurred, the second received IR input signature is identified as a repeat packet and the numeric command provided by the previous packet is provided to the media processing device 105 for execution.

For assigning a data score to protocols that implement PE (e.g., Philips RC-5 and RC-6), the IR signature is still examined for each pulse-space pair, however, data bits associated with prior pulse-space pairs are considered. Similar to the PDE protocols, the data score for the PE protocols is increased when a logic 0 or 1 is identified. However, the data bit translation may occur across pulse-space pairs.

Referring to a table 1202 in FIG. 12, similar to PDE protocols, the PE protocols have expected pulse and space widths defined. Also similar, a tolerance (e.g. 30%) is applied to the widths thereby providing ranges for comparing to the time intervals of the IR signature.

Figure 13:
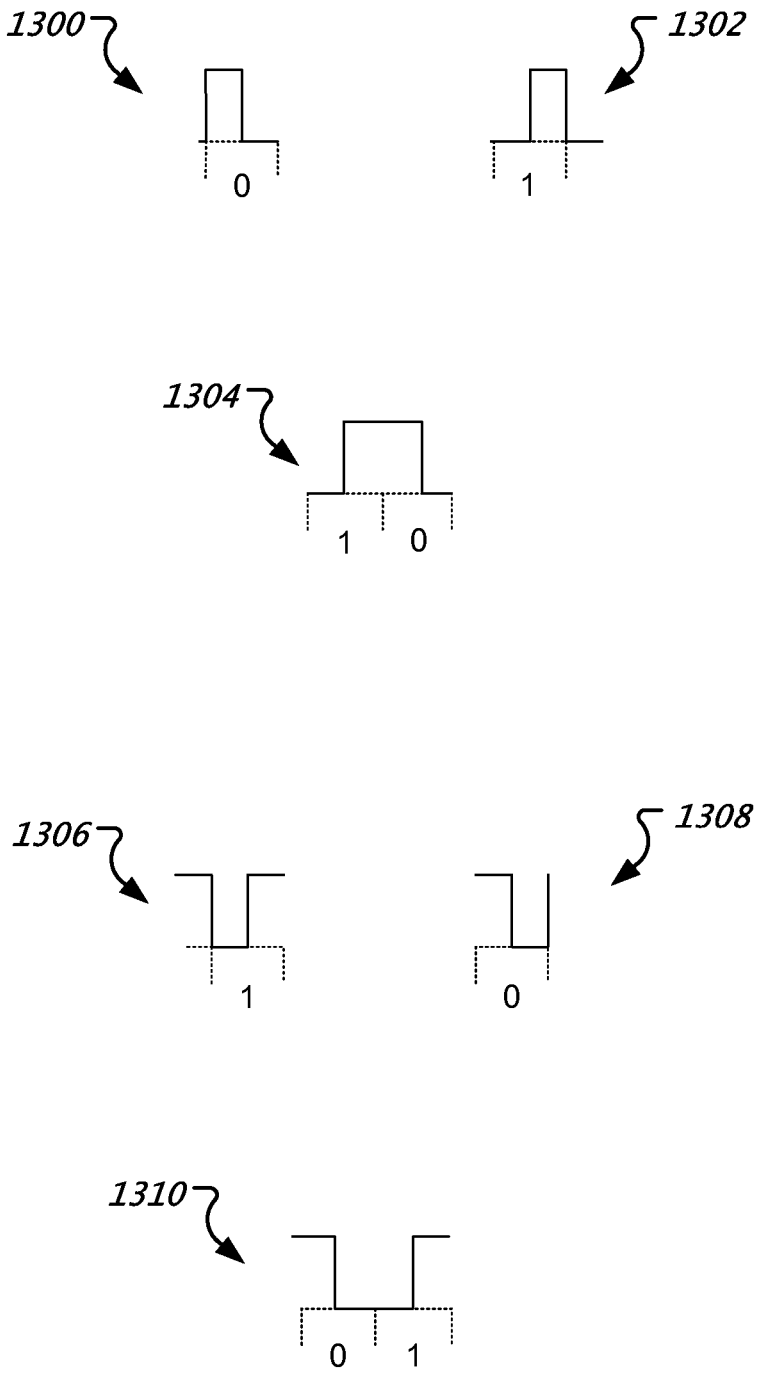
FIG. 13 illustrates properties of an exemplary phase encoding protocol.

Referring to FIG. 13, properties of one particular PE protocol (i.e., the Philips RC-5 protocol) is illustrated. For example, a pulse that complies with this protocol may have a length (e.g., 889 μs) and could indicate the leading end of a logic 0 data bit (time series 1300) or the trailing end of a logic 1 data bit (time series 1302). The pulse may also have a longer length, for example, if the pulse (represented in time series 1304) is twice the length (e.g., two times 889 μs), the pulse may represent the trailing end of a logic 1 data bit and the leading end of a logic 0 data bit. With respect to spaces, a space of a particular length (e.g., 889 μs) may indicate the leading end of a logic 1 data bit (represented in time series 1306) or the trailing end of a logic 0 data bit (represented in time series 1308). If the length of the space is extended (e.g., two time 889 μs), the space can indicate both the trailing end of a logic 0 data bit and the leading end of a logic 1 data bit (represented in time series 1310). Additionally, with regard to the Philips RC-5 protocol, the start pulse can be the second half of a logic 1 data bit, and take the position of a typical header pulse.

Figure 14:
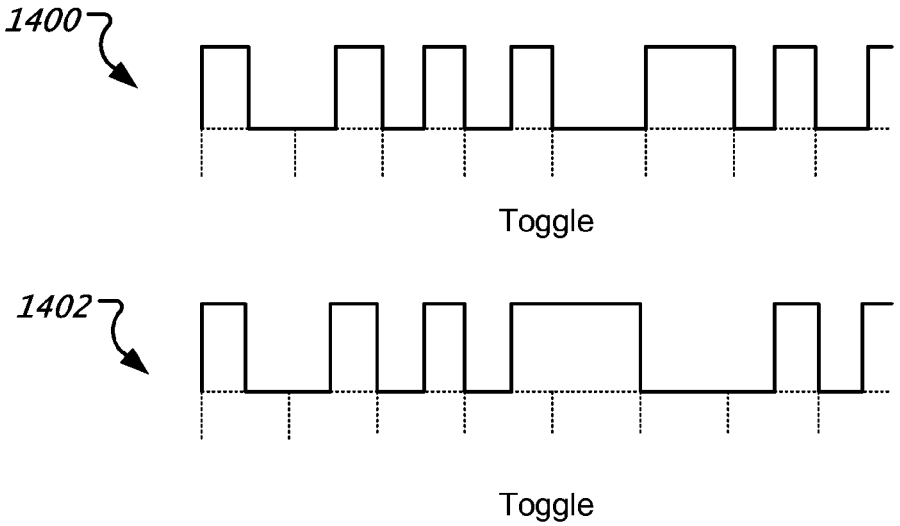
FIG. 14 shows a time series representing a series of pulses in which a time period following the first four data bits provides toggle information.

Other PE protocols also have artifacts to that into account for examining IR signatures. For example, some protocols such as the Philips RC-6 protocol include toggle information. Referring to FIG. 14, a time series 1400 represents a series of pulses in which following the first four data bits, a predefined period of time (e.g., 3556 μs) provides toggle information. In general, the toggle information changes with each instance of a remote control button being depressed. However, the toggle information remains constant during periods in which a button on the remote is pressed (held down). As such for approximately half of this time period, a logic 1 (high level) is provided. Additional instances of pressing a remote buttons toggle the logic 1 level between the first and second half, as represented in time series 1402.

Figure 15:
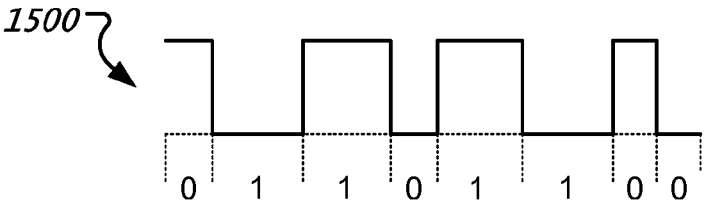
FIG. 15 shows an exemplary protocol that is absent both pulse distance encoding and phase encoding.

Referring to FIG. 15, some protocols appear to be absent both PDE and PE. For example, such a protocol is the DirecTV protocol, in which each individual pulse and space corresponds to a data bit, depending upon the width of the pulse and space (as represented in time series 1500). Additionally, a tolerance (e.g., 30%) may be applied to this protocol (as provided by table 1502). Similar to the DirecTV protocol, the DirecTV Repeat protocol may be recognized by the remote control driver 700. Data scoring and data translation may be similar between the two protocols, with one difference being the width of header pulses and spaces.

Figure 16:
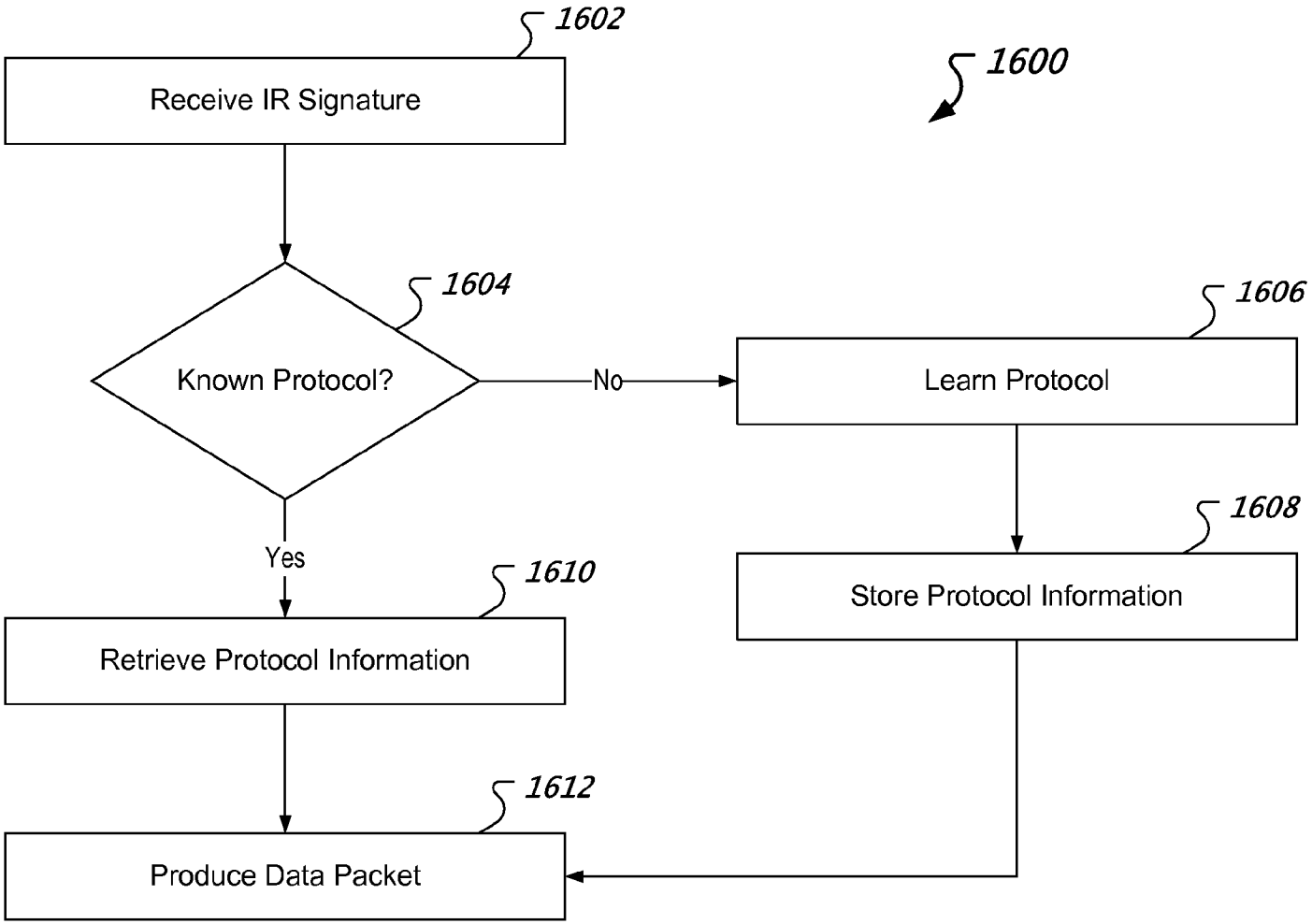
FIGS. 16-18 show flow diagrams describing exemplary operations performed by the remote control driver.

Referring to FIG. 16, a flowchart 1600 represents a particular arrangement of operations of the remote control driver 700. Typically the operations are executed, e.g., by a processor present in the media processing device 105, upon which the remote control driver resides. However, the operations may also be executed by multiple processors present in the device. While typically executed by a single media processing device, in some arrangements, operation execution may be distributed among two or more similar media processing devices.

Operations include receiving 1602 an IR signature. For example, a signature (e.g., the IR signature 702) may be received from the media processing device 105. Operations also include determining 1604 if the protocol of the received IR signature is known to the remote control driver 700. If the signature is unrecognized, operations include learning 1606 the protocol of the received signature and storing 1608 information associated with the protocol of the signature. For example, information associated with particular protocol parameters (e.g., pulse count, header format, data content) may be stored at the media processing device for later retrieval and processing (e.g., protocol recognition, transfer, etc.). Optionally, in some arrangements, an IR signature may be disregarded if not recognized. If the protocol of the received IR signature is recognized, operation of the remote control driver 700 include retrieving 1610 information associated with the recognized protocol. Upon the protocol information being retrieved or newly learned, operations of the remote control driver 700 include producing 1612 one or more data packets that contains information associated with the received IR signature. For example, information that identifies the protocol along with the command included in the IR signature may be contained in the packet(s).

Figure 17:
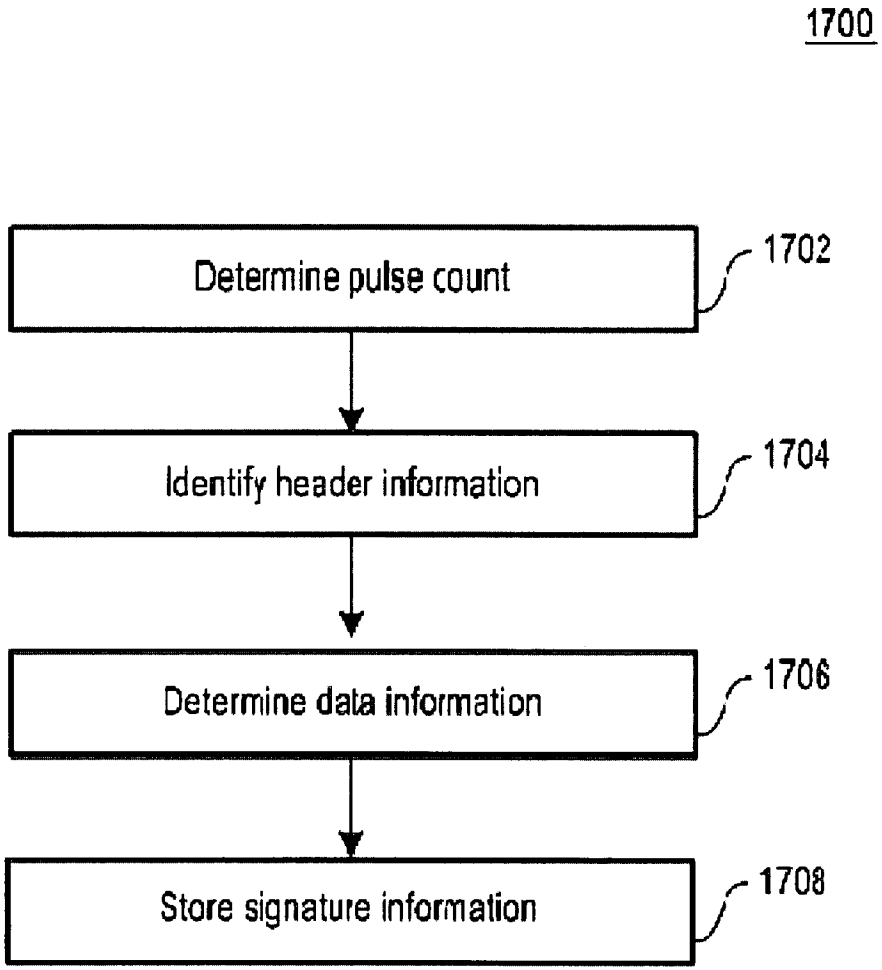

Referring to FIG. 17, a flowchart 1700 represents another set of operations of the remote control driver 700. Similar to the operations of flowchart 1600, these operations are typically executed by a processor present in the media processing device 105, however, in other arrangements distributed processing techniques may be implemented. The flowchart 1700 includes operations associated with learning a protocol (as illustrated in step 1606 in flow chart 1600) from a received IR signature.

Operations include determining 1702 the pulse count of the received IR signature. One or more techniques and methodologies can be implemented for determining the pulse count. For example, pulses included in a series of IR signatures can be summed and averaged to identify an average pulse count. Operations also include identifying 1704 header information associated with the IR signature. For example header pulse width and space width may be determined along with other parameters. Operations may also include determining 1706 data information associated with the IR signature. For example, pulses associated with data bits may be identified along with pulses associated with non-data pulses (e.g., header pulses, stop pulses, etc.). Additional parameters associated with the IR signature may also be identified. Operations also include storing 1708 the collected signature information in a protocol profile (or other similar representation) for later retrieval for other operations (e.g., recognizing a similar IR signature).

Figure 18:
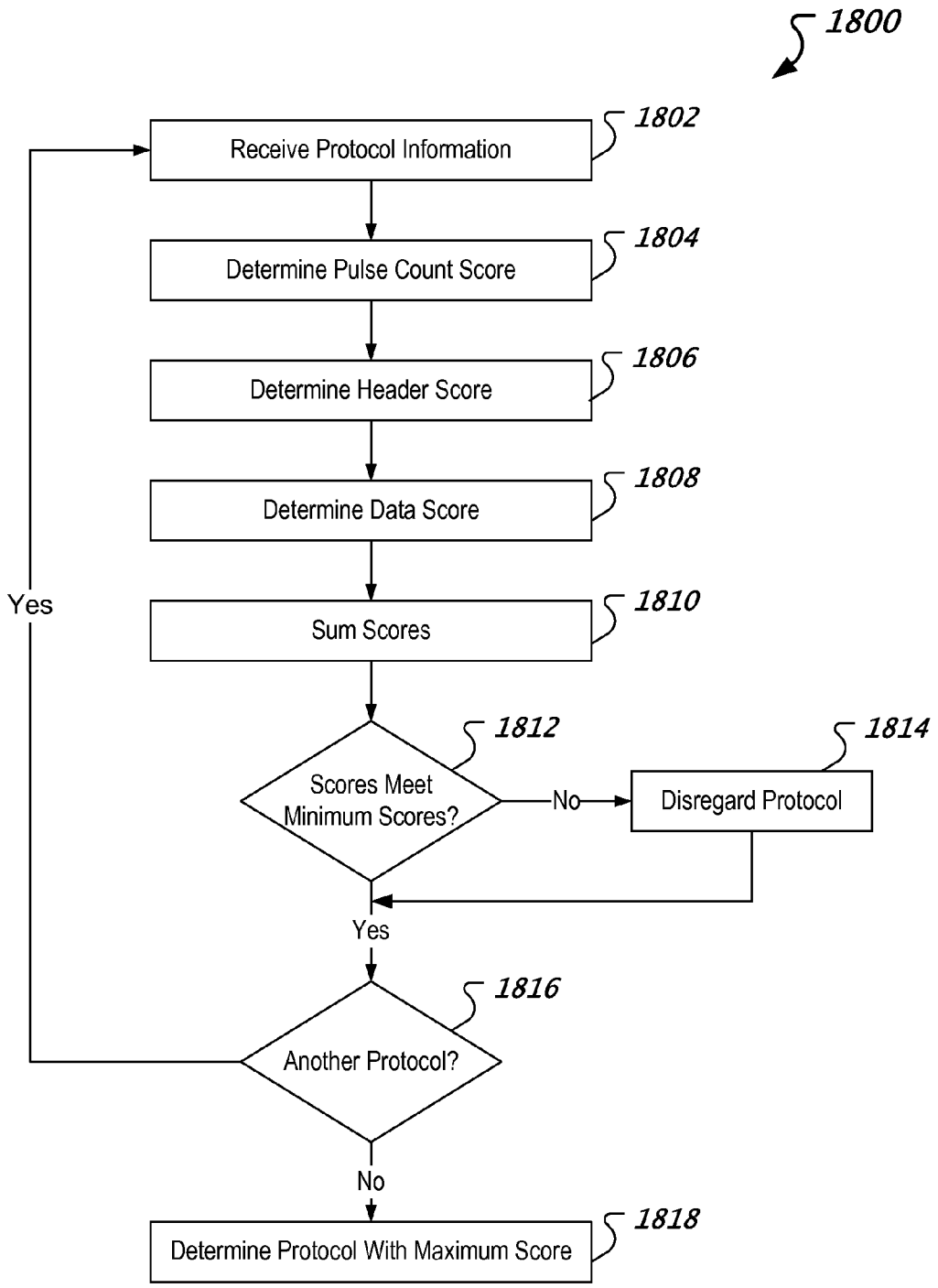

Referring to FIG. 18, a flowchart 1800 represents another set of operations of the remote control driver 700. Similar to the operations of flowcharts 1600 and 1700, these operations are typically executed by a processor present in the media processing device 105, however, in other arrangements distributed processing techniques may be implemented. The flowchart 1800 includes operations associated with determining if a protocol is recognized (as illustrated in step 1604 in flow chart 1600) from a received IR signature.

Operations include receiving 1802 information associated with a particular protocol such as PDE, PE or other similar protocol (e.g., a DirecTV protocol). Upon receiving the information, operations may include determining 1804 a pulse count score for the protocol by comparing the pulse count of the protocol to the pulse count of a received IR signature (e.g., as illustrated in step 1602 in FIG. 16). Along with the pulse count score, operations include determining 1806 a header score. For example, the header pulse width and space width of the protocol may be compared to the corresponding pulse and space widths of the received IR signature. Additionally, operations may include determining a data score, which may include identifying data pulses along with taking data translation into account.

Upon identifying the scores for the protocol, other operations may be executed to determine an overall score metric. For example operations may include summing 1810 the identified scores, however, other mathematical and processing operations (e.g., averaging, etc.) may be included. Operations may also include determining 1812 if one or more of the scores have achieved a minimum threshold. For example, one or more of the individual scores (e.g., the pulse count score, the header score, the data score) may be checked for attaining a corresponding minimum threshold (e.g., a minimum pulse count score). The processed scores may also be checked for attaining a minimum score, for example, the sum of the scores may be compared to a minimum summed score threshold.

If the minimum threshold is not met, operations may include disregarding 1814 this particular protocol from the comparison with the received IR signature. If the minimum threshold or thresholds are met, operations may include determining if another previously know protocol is present for comparing against the received IR signature. If another protocol still remains to be compared, operations include returning to receiving 1802 information associated with this next protocol and repeating the subsequent operations to score the protocol. If no protocol remains to be checked, operations include determining 1818 the protocol with the maximum score from the scored protocols. In this particular arrangement, the maximum score indicates which protocol is most similar to the protocol being used by the received IR signature. However, in other arrangements, other scoring techniques may be implemented. For example, the protocol with a minimum score may be indicative of the protocol most similar to the protocol used by the received IR signature.

Figure 19:
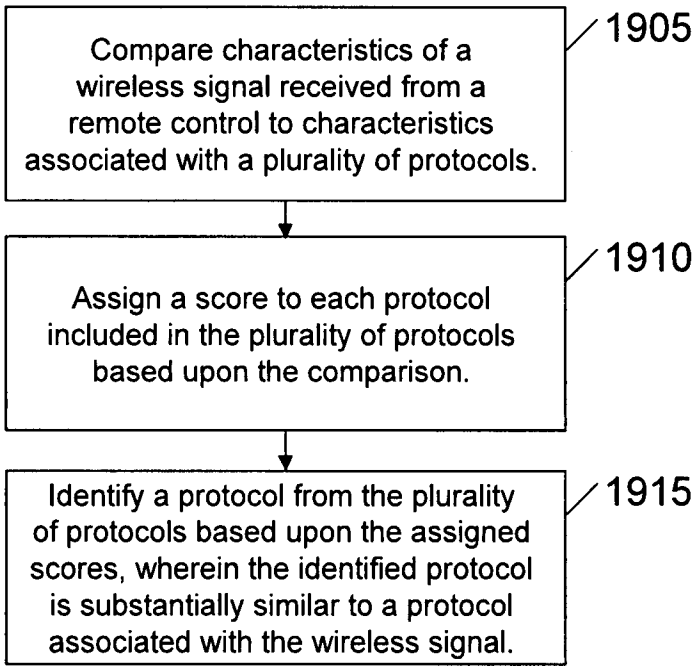
FIG. 19 shows a flow diagram describing an exemplary process identifying a protocol associated with a wireless signal.

FIG. 19 shows a flow diagram describing an exemplary process identifying a protocol associated with a wireless signal. Initially, characteristics of a wireless signal received from a remote control can be compared to characteristics associated with a plurality of protocols (1905). Based upon the comparison, a score can be assigned to each protocol included in the plurality of protocols (1910). A protocol then can be identified from the plurality of protocols based upon the assigned scores, wherein the identified protocol is substantially similar to a protocol associated with the wireless signal (1915).

A number of implementations have been disclosed herein. Nevertheless, it will be understood that various modifications may be made without departing from the spirit and scope of the claims. Accordingly, other implementations are within the scope of the following claims.

What is claimed is:

1. A method comprising:

comparing characteristics of a wireless signal received from a remote control to characteristics associated with a plurality of protocols;

based upon the comparison, assigning a score to each protocol included in the plurality of protocols; and identifying a protocol from the plurality of protocols based upon the assigned scores, wherein the identified protocol is substantially similar to a protocol associated with the wireless signal.

2. The method of claim 1, further comprising:

producing a data packet representative of the identified protocol and contents of the wireless signal.

3. The method of claim 1, wherein comparing characteristics includes comparing pulse counts.

4. The method of claim 3, wherein the assigned score represents the pulse count comparison.

5. The method of claim 1, wherein comparing characteristics includes comparing pulse widths.

6. The method of claim 5, wherein the assigned score represents the pulse width comparison.

7. The method of claim 1, wherein comparing characteristics includes comparing the count of pulses representative of data.

8. The method of claim 7, wherein the assigned score represents the data pulse count comparison.

9. The method of claim 8, wherein the assigned score is adjusted based upon translation of the data pulses.

10. The method of claim 1, wherein assigning the score includes summing sub-scores.

11. The method of claim 1, wherein identifying the protocol includes determining if a threshold assigned score has been attained.

12. A media processing device, comprising:

a receiver for receiving a wireless signal from a remote control; and a remote control driver for comparing characteristics of the wireless signal to characteristics associated with a plurality of protocols, the remote control driver is configured to assign a score, based upon the comparison, to each protocol included in the plurality of protocols, the remote control driver is further configured to identify a protocol from the plurality of protocols based upon the assigned scores, wherein the identified protocol is substantially similar to a protocol associated with the wireless signal.

13. The media processing device of claim 12, wherein the remote control driver is further configured to produce a data packet representative of the identified protocol and contents of the wireless signal.

14. The media processing device of claim 12, wherein comparing characteristics includes comparing pulse counts.

15. The media processing device of claim 14, wherein the assigned score represents the pulse count comparison.

16. The media processing device of claim 12, wherein comparing characteristics includes comparing pulse widths.

17. The media processing device of claim 16, wherein the assigned score represents the pulse width comparison.

18. The media processing device of claim 12, wherein comparing characteristics includes comparing the count of pulses representative of data.

19. The media processing device of claim 18, wherein the assigned score represents the data pulse count comparison.

20. The media processing device of claim 19, wherein the assigned score is adjusted based upon translation of the data pulses.

21. The media processing device of claim 12, wherein assigning the score includes summing sub-scores.

22. The media processing device of claim 12, wherein identifying the protocol includes determining if a threshold assigned score has been attained.

23. One or more non-transitory computer readable media storing instructions that are executable by a processing device, and upon such execution cause the processing device to perform operations comprising:

comparing characteristics of a wireless signal received from a remote control to characteristics associated with a plurality of protocols;

based upon the comparison, assigning a score to each protocol included in the plurality of protocols; and identifying a protocol from the plurality of protocols based upon the assigned scores, wherein the identified protocol is substantially similar to a protocol associated with the wireless signal.

24. The non-transitory computer readable media of claim 23, further comprising instructions to cause the processing device to perform operations comprising:

producing a data packet representative of the identified protocol and contents of the wireless signal.

25. The non-transitory computer readable media of claim 23, wherein comparing characteristics includes comparing pulse counts.

26. The non-transitory computer readable media of claim 25, wherein the assigned score represents the pulse count comparison.

27. The non-transitory computer readable media of claim 23, wherein comparing characteristics includes comparing pulse widths.

28. The non-transitory computer readable media of claim 27, wherein the assigned score represents the pulse width comparison.

29. The non-transitory computer readable media of claim 23, wherein comparing characteristics includes comparing the count of pulses representative of data.

30. The non-transitory computer readable media of claim 29, wherein the assigned score represents the data pulse count comparison.

31. The non-transitory computer readable media of claim 30, wherein the assigned score is adjusted based upon translation of the data pulses.

32. The non-transitory computer readable media of claim 23, wherein assigning the score includes summing sub-scores.

33. The non-transitory computer readable media of claim 23, wherein identifying the protocol includes determining if a threshold assigned score has been attained.

* * * * *